United States Patent [19]

Ozu et al.

[11] 4,326,868

[45] Apr. 27, 1982

[54] REFRIGERATION SYSTEM UTILIZING A GASEOUS REFRIGERANT BYPASS

[75] Inventors: Masao Ozu, Fuji; Keiichi Morita, Fujinomiya; Hiroshi Itoh, Fuji, all of Japan

[73] Assignee: Tokyo Shibaura Denki Kabushiki Kaisha, Kawasaki, Japan

[21] Appl. No.: 104,729

[22] Filed: Dec. 18, 1979

[30] Foreign Application Priority Data

Dec. 20, 1978 [JP] Japan ..... 53/156306

[51] Int. Cl.[3] ..... F25B 13/00; F25B 5/00

[52] U.S. Cl. ..... 62/324.6; 62/117; 62/196 C; 417/284

[58] Field of Search ..... 62/196 A, 324 A, 510, 62/117, 511, 196 C, 196 B; 417/284, 440

[56] References Cited

U.S. PATENT DOCUMENTS

| | | | |
|---|---|---|---|
| 2,299,811 | 10/1942 | Feicht . | |
| 2,363,273 | 11/1944 | Waterfill | 62/196 C |
| 2,904,971 | 9/1959 | Kosfeld | 62/196 C |
| 3,210,958 | 10/1965 | Coyne | 62/324 |
| 4,211,093 | 7/1980 | Midolo | 62/505 |

FOREIGN PATENT DOCUMENTS 52-24362 7/1977 Japan .

*Primary Examiner*—William E. Wayner

*Attorney, Agent, or Firm*—Oblon, Fisher, Spivak, McClelland & Maier

[57] ABSTRACT

The present invention provides a refrigeration or heating system which includes a high pressure gaseous refrigerant bypass which introduces high pressure gaseous refrigerant to the compressor through a hole therein. This reintroduction of high pressure gaseous refrigerant increases the work capacity of the compressor, which is particularly valuable in the heating mode where the ambient temperature is low, and also hastens the pressure rising characteristics of the compressor. A low pressure gaseous refrigerant bypass to the compressor may also be provided for permitting a portion of the compressed refrigerant in the compressor to be discharged, thereby reducing the danger of overheating of the compressor. A further feature of the invention is the introduction of low enthalpy refrigerant into the compressor which will also cool an overheated compressor. Appropriate control means are provided for controlling the flow of refrigerant through the bypasses.

18 Claims, 15 Drawing Figures

REFRIGERATION SYSTEM UTILIZING A GASEOUS REFRIGERANT BYPASS

BACKGROUND OF THE INVENTION

1. Field of the Invention

The present invention relates generally to a refrigeration system and more particularly to a refrigeration system having a high pressure gaseous refrigerant bypass which introduces high pressure gaseous refrigerant into the compressor resulting in the increased heating capacity and expeditious pressure rising characteristics.

2. Description of the Prior Art

In a refrigeration system called a heat pump type refrigeration cycle, a cycle reversibly assembled so that the heat discharged at the condenser can be used as a heating resource, there have been a large assortment of refrigeration systems.

A drawback to the heat pump type refrigeration system results from the insufficient heat supply capacity which often occurs when the outdoor temperature gradually decreases or when it is very cold outside.

Since the users need larger heating capacity as the temperature drops down the insufficiency of the heat supply becomes a serious technical problem.

The heat supply capacity heretofore has been supplemented by electric heaters incorporated in the interior unit near the heat exchanger, thus producing the necessary amount of heat.

The electric heater, however, consumes a large quantity of electricity, so that the power supply must be at least as large as the total amount of supplies for the refrigeration system itself and for the electric heater.

Furthermore, care must be taken for the safety measures that are provided in the interior unit against possible dangers, such as a fire set off by an electrical leakage or by the direct contact of the electric heater with inflammable components inside the interior of the unit.

On the other hand, in the field of air-conditioning which uses refrigeration cycle, a skill has been developed for preventing overheating of the compressor by providing the cylinder thereof with a small hole, through which the liquid refrigerant is injected and evaporated.

The introduced liquid refrigerant, while instantly evaporating upon entering the compression chamber, absorbs enthalpy from the refrigerant which is in the compressing process and soon comes to have a normal temperature.

The temperature of the refrigerant which comes out of the compressor, therefore, can be subject to control due to the amount of injected liquid refrigerant.

Although this injection type compressor can contribute to a decrease in the temperature of the discharged refrigerant for the cooling function, it by no means helps either to quicken the pressure rising characteristics or to add to the heating capacity available.

SUMMARY OF THE INVENTION

Accordingly, it is an object of the invention to improve the heating capacity of the refrigeration system.

It is another object of the invention to insure the refrigeration system a prompt pressure rising characteristic for the heating capacity which leads to the prevention of an initial cold air flow from the interior of the unit.

It is another object of the invention to provide a compact compressor for the refrigerant system.

A further object of the invention is to present a refrigeration system with an improved compressor which creates an increased heating capacity.

Still another object of the invention is to provide a refrigeration system which can operate with a decreased capacity when the load is light and with an increased capacity when the load is heavy.

BRIEF DESCRIPTION OF THE DRAWINGS

Various other objects, features and attendant advantages of the present invention will be more fully appreciated as the same become better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
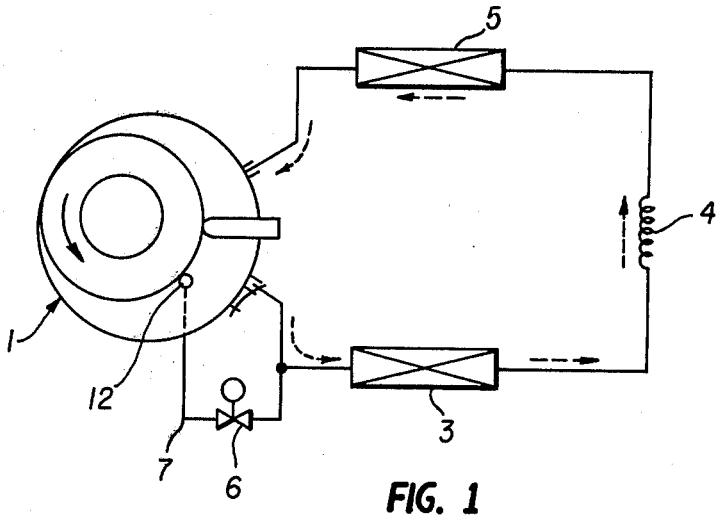
FIG. 1 is a schematic view of the fundamental refrigeration cycle having a gaseous refrigerant bypass.

Referring now to FIG. 1 the refrigerating system comprises a compressor 1 which compresses refrigerant and pumps it out firstly to a condenser 3 connected therewith. The condenser 3 is connected to the compressor 1 and introduces and condenses the compressed refrigerant, and then connects to a capillary tube 4 functioning as an expanding means. An evaporator 5 is connected with the capillary tube 4 at which refrigerant evaporates. The vaporized refrigerant flows out of the evaporator 5 and returns to the compressor 1.

In the meantime a gaseous refrigerant bypass 7 is additionally provided between the condenser 3 and the compressor 1.

In order to control the refrigerant flow an electromagnetic valve 6 is attached to the bypass.

It should be understood that in operation part of the refrigerant discharged from the compressor diverges into the bypass line 7, flows through the control valve 6 and then returns to the compressor 1.

Clearly, the amount of diverged refrigerant flow can be controlled depending on the operating conditions.

Figure 2:
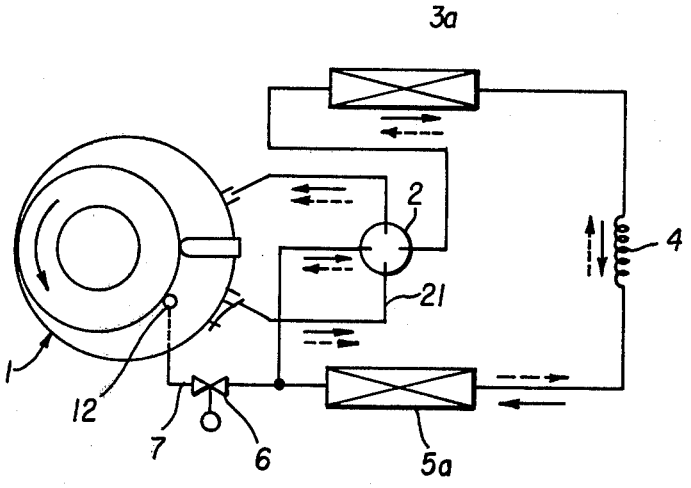
FIG. 2 is a refrigeration cycle of this invention applied to a heat pump type refrigeration system.

The same concept can be applied to a heat pump type refrigeration system as shown in FIG. 2. The like characters therein indicate like parts as described above.

A four-way reversing valve 2 is utilized to direct the refrigerant from the compressor by way of conduit 21 into either of the two heat exchangers and simultaneously direct the output from the other coil and into the input of the compressor 1.

An outdoor heat exchanger 3*a* functions both as a condenser when the cycle is in the cooling mode and as an evaporator when the cycle is in the heating mode.

An indoor heat exchanger 5*a* serves both as an evaporator when the cycle is in the cooling mode and as a condenser when the cycle is in the heating mode.

In this embodiment a gaseous refrigerant bypass 7 is also provided between the injection hole 12 of the compressor 1 and the indoor heat exchanger 5*a*.

Note that the solid line arrows denote the refrigerant flow in the cooling mode and the broken line arrows denote the refrigerant flow in the heating mode.

A control valve 6 is provided in the bypass line 7 in order to insure a stable return supply of the gas refrigerant, so that in operation, in proportion to the extent that the control valve 6 is open, gas refrigerant diverges at the junction between the control valve 6 and the indoor heating coil 5*a* and flows back to the inlet 12 of the compressor 1.

Figure 3:
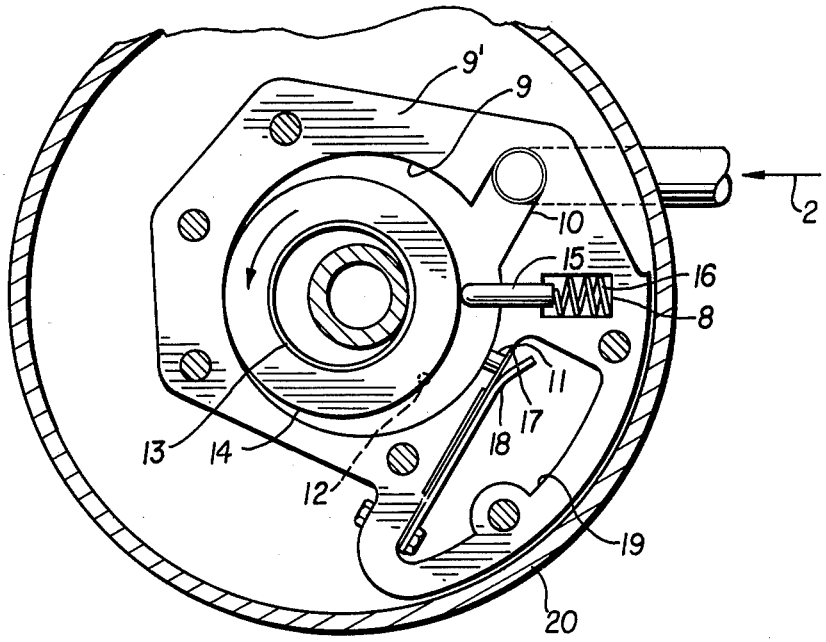
FIG. 3 shows a cross-sectional view of the compressor employed in the refrigeration system of the invention which is provided with an injection hole formed on the cylinder thereof.

In FIG. 3 there is shown a schematic cross-sectional view of the compressor 1 shown in FIG. 2.

A particular feature of the present invention is the compressor 1. In order to define a compression chamber 9 a cylinder 9′ is provided inside an exterior casing 20.

In the center of the cylinder 9′ is placed a shaft 13 which is connected with a rotator (not shown) to convey rotation and the cylinder 9′ is surrounded by a roller 14 in a close relationship with the inner surface of the cylinder 9′.

As the shaft 13 and the roller 14 are eccentric, the roller 14 moves in such a manner in the compression chamber 9 that it touches and presses the inner surface of the cylinder at a variable point. That is, the point of contact circulates within the cylinder's inner surface continuously, dividing the compression chamber 9 into two chambers, a suction side chamber and a discharge side chamber.

This can be achieved with the aid of the blade 15 which is provided in contact with the roller 14. The blade 15 is inserted in a recess 8 in which a supporting spring 16 is accommodated, and moves reciprocally along a slot 15 while contacting and pressing the roller 14.

In the embodiment shown in FIG. 3 the shaft 13 and the roller 14 rotate in the counterclockwise direction. But due to the slip between the shaft 13 and the roller 14 the rate of rotation of the roller 14 is considerably less than that of the shaft 13.

For the compressor to suck in the refrigerant the inner wall of the cylinder 9′ is provided with a suction port 10 and a discharge port 11.

The suction port 10 is provided in communication with the evaporator through the four-way reversing valve 2. The evaporated refrigerant enters the compression chamber 9 by way of the suction port 10 while the roller 14 is, at the same time, compressing the refrigerant.

The roller 14 continues compressing the refrigerant until it discharges it from the discharge port 11.

The discharge port 11 is concerned with properly discharging the compressed refrigerant at a predetermined pressure level and at obviating adverse currents. For this purpose the discharge port 11 is provided with a discharge valve 17 made of an elastic metal member. The plate valve 17 is designed to open and to allow the refrigerant out.

To avoid malfunctioning of the plate valve 17 a check plate 18 is also attached in such a way that during operation it controls the lift of the plate valve 17. The plate valve 17 and the check plate 18 are secured together at their ends by a bolt to the cylinder 9′ in a conventional manner.

As can be seen from the FIG. 3 no valve is provided for the suction port 10.

To attain the efficiency envisaged by the instant invention the bottom wall of the cylinder 9′ is provided with an aperture or a hole 12.

The aperture 12 is in communication with the high pressure gaseous refrigerant zone. Namely, as shown in FIG. 1, the aperture 12 is communicating with the refrigerant conduit connecting the compressor 1 and the condenser 3. Of course the aperture 12 can be connected to anywhere in the first half of the condenser so fas as it is in communication with the high pressure gaseous refrigerant.

With adequate pressure, part of the high pressure gaseous refrigerant returns into the compression chamber 9 during the compressing process through the aperture 12.

The size, shape and the location of the aperture 12 may be individually determined.

Let us assume that the roller is in the "0°" position when the blade 15 is most deeply submerged in the recess 8, and in the "180°" position when the blade 15 protrudes to the maximum and "360°" when the blade 15 returns to the most deeply submerged position after a single rotation of the roller 14.

Desirably, the aperture 12 is so located that it begins to open immediately after the roller 14 passes its "20°" position, at which the suction port 10 is located, and completely closes when the roller 14 comes somewhere between "180°" and "210°" position.

For example, the position of the aperture 12 may be set at the "290" roller position and at an adequate distance from the cylinder wall to begin to open at "20°", open in full at "110°" and again completely close at "200°".

So it is very clear that during a single rotation of the roller 14 the refrigerant flows in from the suction port 10, is compressed, and is discharged from the discharge port 11 into the discharge chamber 19.

In the meantime high pressure refrigerant comes in through the aperture 12 of its own accord when it is opened, and at this time the pressure inside begins to rise sharply till it reaches the discharge level.

All of the mixed refrigerant flows out the discharge valve 17, yet part of the discharged refrigerant returns to the compression chamber 9 by way of the aperture 12 thus helping to produce a larger compression work for the compressor 1.

The other characteristics of the aperture 12 should also be determined individually. The shape, for example, need not be necessarily circular. It may be oval, semi-triangular or crescent.

Figure 4:
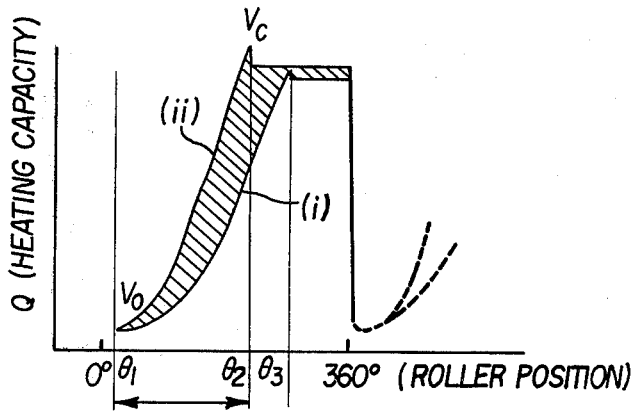
FIG. 4 shows the characteristics of the pressure P in the compressing chamber in relation to the rotation angle $\theta$ of the roller shown in FIG. 3.
Figure 5:
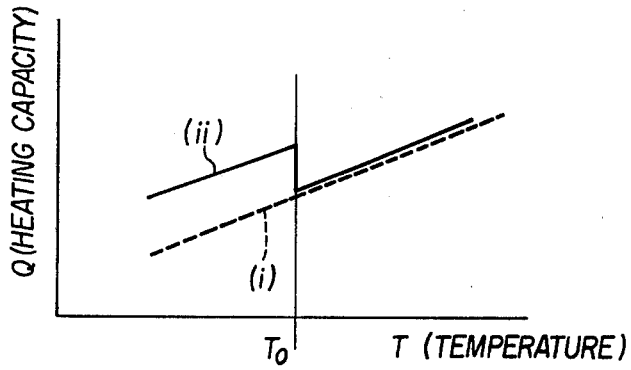
FIG. 5 shows the characteristic of the heating capacity Q of this invention as compared with that of the conventional type with the outdoor temperature T.
Figure 6:
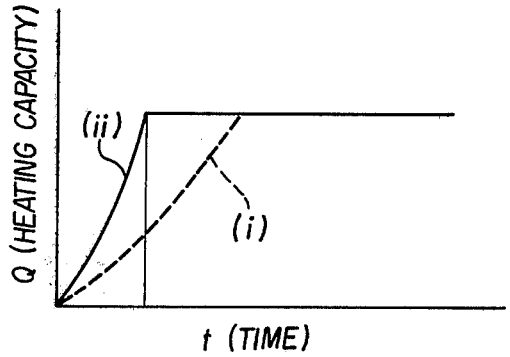
FIG. 6 shows on the vertical scale the increase of the heating capacity Q of this invention as compared with that of the prior art against the time t on the horizontal scale.

The particular advantages of the invention are clearly demonstrated with reference to the following FIGS. 4–6.

In FIG. 4, the characteristics of the pressure in the compression chamber (P) is shown in relation to the roller position ($\theta$) for the current invention (ii), in a lucid comparison with the pressure characteristics for a typical prior art compressor (i).

In prior cases the pressure starting at $\theta_1$ rises relatively slower, reaches the maximal pressure at $\theta_3$ then levels off.

In contrast, however, the pressure rising characteristic for the current invention (ii) is steeper than that of the prior case (i).

The reason for this is that just after the suction process is over at the pressure $V_0$, high pressure refirgerant is introduced into the compression chamber through the aperture 12, causing the pressure to rise more rapidly to the maximal pressure Vc at $\theta_2$. And $\theta_2$ falls approximately at the 200° roller position.

Obviously, it should be understood that in FIG. 4 the oblique-lined area surrounded by both the waveform (i) and the waveform (ii) corresponds to the amount of increase in the work to be given the compressor. Consequently, the work that the compressor of this invention is expected to perform will become greater than in the preceding ones.

The refrigerant pressure continues to rise so long as the aperture 12 remains open, but stops increasing when the discharge valve 17 opens to release the compressed refrigerant.

The maximal pressure Vc remains at approximately the same level once the discharge valve 17 has been opened at about the "200°" roller position since the opening timing of the discharge valve 17 is so adjusted that the valve opens soon after the aperture 12 is completely closed by the bottom surface of the cylinder 14.

In FIG. 5, there is shown the characteristic of the heating capacity Q in relation to the outdoor ambient temperature T.

The heating capacity hitherto has been such that with the fall of the outdoor ambient temperature T the heating capacity Q lowers as we see from the broken line (i) in FIG. 5. This has presented a major technical issue because normally the lower the ambient temperature becomes the more heating capacity is needed.

According to this invention, as the compressor is designed to achieve more work, when the aperture 12 is open and gas injection is added to To, it offers substantially more heating capacity as we see from the solid line (ii) in FIG. 5. At the same time, as the compressor is able to warm up in substantially less operating time as denoted by the reference character t from the FIG. 6 it poses less of a problem of what is called a "cold draft"; that is, an initial cold air flow from the indoor heat exchanger caused by prolonged warm-up.

Naturally a person skilled in the art may easily smooth the characteristic of the Q—T curve in FIG. 5 in the design of a refrigeration system simply by controlling with the control valve the amount of refrigerant injected into the compressor 1.

Figure 7:
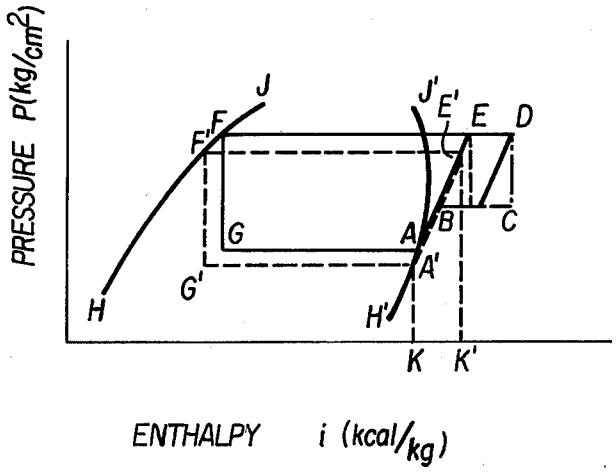
FIG. 7 is the pressure (P)—enthalphy (i) diagram which shows the characteristics for the refrigeration cycle of the present invention.

In FIG. 7 a further explanation is given using a pressure-enthalpy diagram. In winter the refrigeration starts with the cycle formation drawn in the dotted-line trapezoid A'E'F'G'.

Here the line JH and J'H', respectively represent the saturated liquid and saturated vapor lines of a refrigerant.

Point F' indicates the state of a kilogram of the refrigerant upon issuance from the condenser of a simple conventional refrigeration system, and point G' represents the state of said refrigerant after constant enthalpy expansion along line F'G'.

The liquid refrigerant passes through the evaporator, changing its condition along line G'A'. The evaporated gas refrigerant is then recompressed along line A'E', necessitating an expenditure of work per kilogram which, in terms of heat units, is equal to the projection K–K' on the enthalpy axis.

The compressed refrigerant is then returned through the condenser to the state F and the cycle is ready to repeat.

During operation as the compressor gradually becomes warmed up the refrigeration cycle turns to a new higher formation, namely the one shown by the trapezoid A E F G.

Since in the early stage of the operation the aperture 12 is opened, forming the gas refrigerant bypass cycle, the time needed to warm up the compressor is comparatively shorter.

Because the high pressure refrigerant at point E, which has just been discharged from the compressor, again enters and joins the refrigerant undergoing the compression process in the compression chamber the resultant refrigerant reaches a higher pressure than in the previous stage.

So after every cycling the pressure of the discharged refrigerant becomes bit by bit higher, but within a certain operation period the pressure will converge into a balanced pressure level, point D.

In addition as the refrigerant being compressed is joined by the high-enthalpy refrigerant the total enthalpy of the discharged refrigerant per kilogram will increase as from the point B to the point C. The compressor will continue to compress the mixed refrigerant as from the point C to point D.

Finally the refrigeration cycle will settle down to the formation ABCDEFGA. Note that there are numerous transitional formations between the initial one and the finally stabilized one.

Also note that the amount of work added to the refrigeration cycle is represented by the segment ED.

In the heating-mode operation this additional enthalpy will result in an increase in the form of the heat which can be retrieved at the condenser.

By controlling the amount of refrigerant which directly returns to the compressor a greater heat capacity will be available per kilogram of refrigerant.

Figure 8:
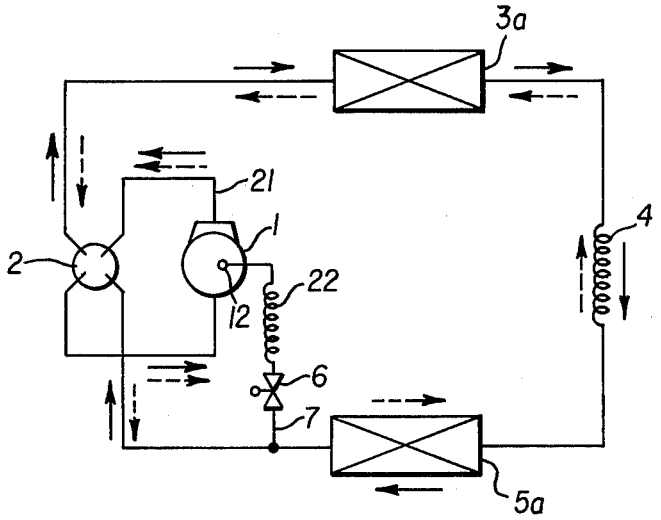
FIG. 8 shows another example of the present invention applied to a heat pump type refrigeration system which has a flow control means in the gaseous refrigerant bypass.

In FIG. 8 another embodiment of this invention is explained.

In this embodiment the gaseous refrigerant bypass line 7 is further provided with a capillary tube 22. This gives the bypass line a resistance that can insure a stable expansion of compressed refrigerant.

Figure 9:
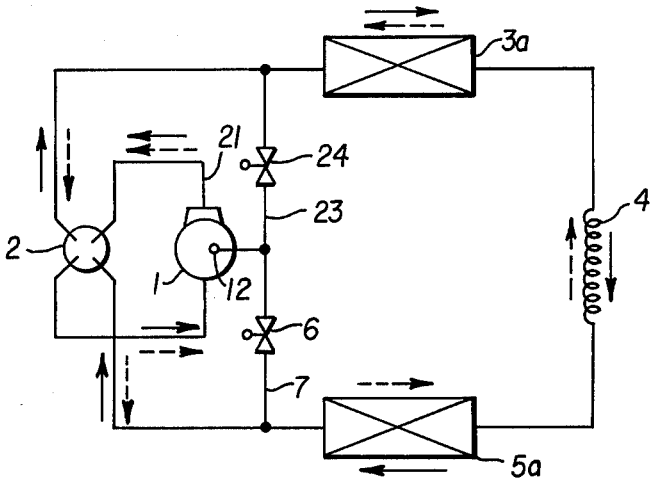
FIG. 9 shows another example of the present invention applied to a heat pump type refrigeration cycle having a pair of gaseous refrigerant bypasses for both its cooling cycle line and heating cycle line.

FIG. 9 shows another example of the present invention. In this example another gas refrigerant bypass 23 is also provided which links the outdoor coil 3*a*, the heat exchanger functioning as a condenser in the cooling mode, to the injection aperture 12 of the compressor 1.

The gas refrigerant bypass 23 is provided with a control valve 24 so as to restrict the return of refrigerant back into the injection hole 12 of the compressor 1.

Since the gas bypass line 23 connects the outdoor coil 3*a* to the compressor 1, gas refrigerant can also be injected into the compressor when the refrigeration cycle is in the cooling mode.

Further referring to FIG. 9 a solid-line-arrow denotes the refrigerant flow for the cooling mode and a dotted-line-arrow for the heating mode.

In the heating mode, when both of the control valves 6, 24 are closed, the compressor 1 discharges compressed refrigerant to the four-way reversible valve 2 and to the indoor coil 5*a* in a normal manner.

At the indoor coil 5*a* the refrigerant releases heat and condenses. The condensed refrigerant then passes the capillary tube 4 and expands during which part of the refrigerant becomes flash gas.

The liquid refrigerant then proceeds to the outdoor coil 3*a* where it absorbs heat and evaporates.

The evaporated gas as a final step returns to the compressor 1 by way of the four-way valve 2.

And in the heating mode, when the control valve 24 is closed and the control valve 6 is open, though the compressor discharges compressed refrigerant to the indoor coil 5*a* by way of the four-way reversible valve 2 in the same manner as aforementioned, part of the compressed refrigerant digresses from the main flow and returns to the compressor 1 through the control valve 6.

This, as has been so far seen, will add to the heating capacity that the refrigeration cycle affords and in addition the pressure rising characteristic of the system will be particularly improved.

In the heating mode, when the load for the compressor is very heavy, which often occurs when the ambient temperature is relatively high for a heating operation, the control valve 24 should be open and the control valve 6 is closed.

In this case, since the aperture 12 is in communication with the low pressure area, a large part of the compressed refrigerant during the compressing process escapes therefrom, thus alleviating the excessive load.

On the other hand in the cooling mode, when both the valves are closed a normal type operation can be achieved. The compressor 1 firstly sends compressed refrigerant to the outdoor coil 3*a* via the four-way valve 2, then directs the refrigerant to the capillary tube 4 where it expands and then the refrigerant proceeds to the coil 5*a*.

The refrigerant evaporates as it absorbs heat from the surrounding air passing through the indoor coil 5*a*, then returns to the compressor through the reversible valve 2.

In the cooling mode, when the control valve 24 is open and the valve 6 is closed, part of the compressed refrigerant discharged from the compressor directly returns to the compressor 1 through the control valve 24. This will prompt the compressor to rise up to normal capacity faster than otherwise.

Also, in the cooling mode, when the ambient temperature is not high so as to not need much cooling supply, the valve 24 should be closed and the valve 6 opened.

In such a case, the high-pressure compressed refrigerant escapes from the aperture 12 and joins the refrigerant which has passed through the indoor coil 5*a* and is at a low-pressure so that the load for the compressor will be markedly reduced while maintaining the cooling capacity at a certain level.

The cooling capacity available can be controlled by the control valve 6 from the maximum level to nearly half or lower depending on the amount of refrigerant escaping from the compression chamber and on the degree of opening of the valve 6.

Figure 10:
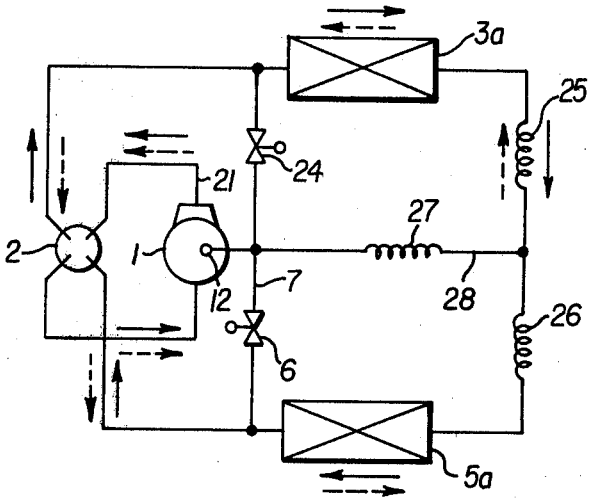
FIG. 10 shows another example of the present invention applied to a heat pump type refrigeration system having a liquid injection line.

Referring to FIG. 10, an additional modification to the embodiment shown in FIG. 9 is presented, in which a capillary tube is divided into two separate expanders 25 and 26, and a refrigerant bypass 28 is provided between the junction of the bypasses 6, 23 and the junction between the two expanders 25 and 26.

The two expanders 25, 26 in cooperation with each other can function as a single capillary tube.

In either mode of operation, the refrigerant expands to a middle pressure after getting through one of the expanders 25 or 26.

A mixture of flash gas and liquid refrigerant flows into the capillary 27 and expands to a low pressure thus forming mostly liquid refrigerant.

Because the refrigerant bypass line 28 assures a constant supply of liquid refrigerant to the compressor, if the hot, high pressure refrigerant directly returns to the compressor or if the compressor is about to be excessively heated the injected liquid refrigerant immediately evaporates in the compression chamber and absorbs heat and prevents overheating of the compressor.

Figure 11:
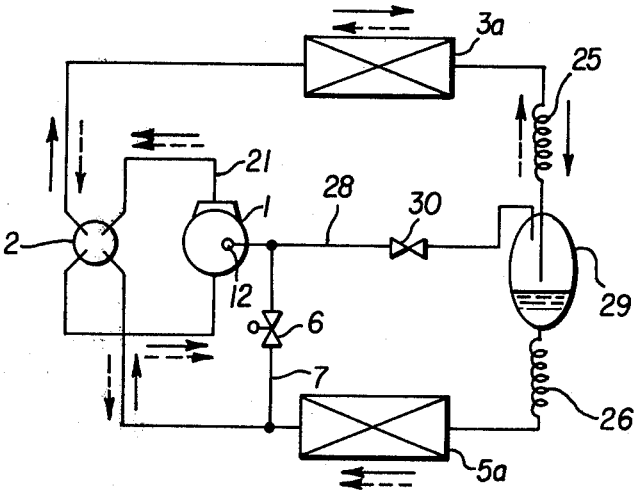
FIG. 11 shows another example of the present invention applied to a heat pump type refrigeration system including a liquid-gas refrigerant separator placed between the condenser and the evaporator from which separated gaseous refrigerant is supplied into the compressor.

FIG. 11 shows a different example of an embodiment of the invention. There are provided two capillary expanders 25, 26, between which an accumulator 29 is connected.

A refrigerant bypass 7 links the compressor 1 to the indoor coil 5*a* so that during the heating mode operation it can return compressed refrigerant directly to the compressor 1 and during cooling mode operation it can release the refrigerant in the compression process to the low pressure zone.

The accumulator 29 and the bypass line 7 are associated with the bypass line 28 which has a control valve 30 therebetween.

Through the refrigerant bypass 28 flows gas refrigerant which has been separated from liquid refrigerant in the accumulator 29.

Since the accumulator 29 is in the middle of the two expanders 25 and 26 both gas refrigerant and the liquid refrigerant have middle pressure and a middle temperature.

The cmpressor 1 allows the gas refrigerant into the compression chamber. The amount of gas is controlled by the valve 30 and the injected refrigerant absorbs the enthalpy from the ambient refrigerant and helps to decrease the temperature.

A person skilled in the art could without difficulty introduce liquid refrigerant from the accumulator 29 by submerging the end opening of the refrigerant bypass 28 in the refrigerant reservoir or he could mix both gas refrigerant and liquid refrigerant into an appropriate moisture gas and inject it into the compression chamber, resulting in the decrease in the temperature of the compressor 1.

The temperature inside the accumulator can be set to a desired level by giving the appropriate balance to the expanders 25, 26.

Figure 12:
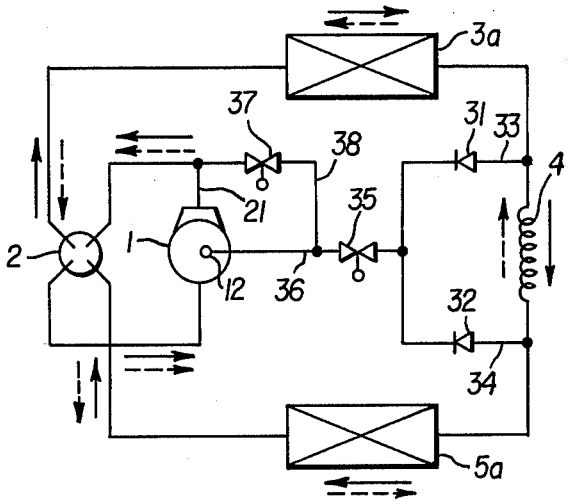
FIG. 12 shows another example of the present invention applied to a heat pump type refrigeration system having a gaseous bypass which is joined by another high pressure, liquid refrigerant flow bypass.

FIG. 12 diagrammatically illustrates a refrigeration cycle which comprises a set of gas bypasses 33, 34, 36 and 38 employing control valves 37, 35 and a pair of check valves 31 and 32.

A gas refrigerant bypass 38 is provided immediately after the compressor 1 and before the four-way reversible valve 2. The bypass is provided with a control valve 37.

A pair of bypass lines 33, 34 are provided in a way that they form a bypass bridge over the capillary tube 4 and each includes a check valve therein.

Both of the check valves 31, 32 are directed to the compressor 1 via the bypass 36 which connects both ends of the check valves 31, 32 and the compressor 1.

The whole cycle is designed to operate in a manner described below.

In the heating mode operation the control valve 37 should be opened and the control valve 35 should be desirably shut at the earlier stage of the operation so as to increase the compression work and to produce more heat and prompt heating capacity.

When a normal operation is desired both of the control valves 37, 35 are closed. The refrigerant then follows the normal course of arrangement. Namely, in the heating operation the following order is followed: the compressor 1, the four-way reversible valve 2, the indoor coil 5*a*, the capillary tube 4, the outdoor coil 3*a*, the four-way valve 2 and finally the ompressor 1; and in the cooling mode, vice versa.

If the compressor 1 has become a bit overheated the control valve 35 should be opened. Then the refrigerant which has passed through the first heat exchanger working as a condenser will flow by way of either check valve to the control valve 35 and will flow into the compressor 1. The control valve 37 at this occasion should be closed in order to prevent the discharged high pressure refrigerant from obstructing the condensed refrigerant in flowing into the compression chamber, since the discharged refrigerant has a higher pressure than does the refrigerant which has passed through the condenser.

Figure 13:
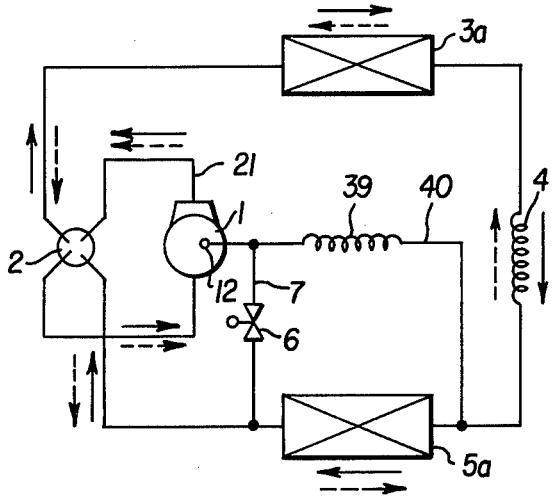
FIG. 13 shows another example of the present invention applied to a heat pump type refrigeration system in which the mixture of gaseous refrigerant and liquid refrigerant can be injected into the compressor.

FIG. 13 shows another modified embodiment of the invention. A gaseous refrigerant bypass 7 connects the compressor to one end of the indoor coil 5*a* which works as the condenser when the entire cycle operates a heating apparatus.

The refrigerant bypass 7 is provided with a control valve 6 for controlling the amount of refrigerant bypass flow.

Another gas bypass line 40 is provided for connecting the compressor 1 and the exit of the indoor coil 5*a* when it functions as a condenser in the heating mode operation. This arrangement of elements enables the mixture of gaseous refrigerant from the line 7 and condensed refrigerant from the line 40 to be injected into the compression chamber of the compressor in order to enlarge the compression work of the compressor but without creating excessive heat.

According to this embodiment the compressor 1 can be unloaded in the cooling mode operation by discharging halfway-compressed refrigerant through the control valve 6 to the exit of the indoor coil which is to be operated as the evaporator in the low pressure zone, so that the cooling capacity can be reduced to a desired level.

Figure 14:
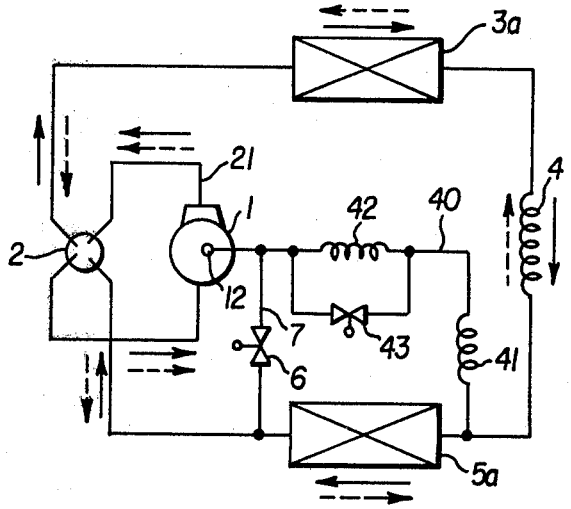
FIG. 14 shows another example of the present invention applied to a heat pump type refrigeration system in which the mixture of gaseous refrigerant and liquid refrigerant is injected into the compressor.

FIG. 14 represents a further modification of the refrigeration cycle shown in FIG. 13. The capillary tube which in FIG. 13 appears as 39 is separated into two capillary tubes 41 and 42. The capillary tube 42 is provided with a bypass conduit having a control valve 43.

In this example the pressure and flow rate of the liquid refrigerant can be controlled depending on the openness of the control valve 43.

Figure 15:
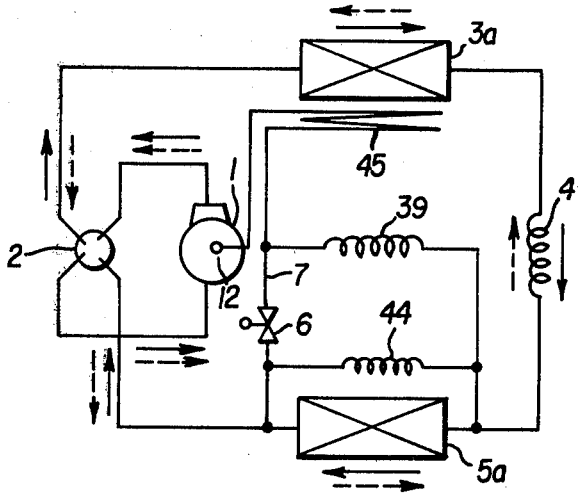
FIG. 15 shows another example of the present invention applied to a heat pump type refrigeration cycle in which the gaseous refrigerant bypass is used as a defrosting heater.

In FIG. 15 a heat-pump type refrigeration cycle employing a defrost means is presented. Near the outdoor coil 3*a* is provided a high-temperature defrost conduit 45 which forms part of the gaseous refrigerant bypass 7.

Because discharged refrigerant from the compressor 1 has a large enthalpy and a high temperature it can give the outdoor coil 3*a* a considerable amount of heat so that if in a heating mode operation part of the outdoor coil 3*a* is frozen it can be defrosted while continuing to function as an evaporator.

Two capillary tubes 39, 44 provided in parallel across the indoor coil 5*a*, and a control valve 6 connected between the capillary tubes and linking the defrost conduit 45 to one end of the indoor coil 5*a* constitute a particular feature of the invention.

Since the capillary tube 39 is connected between the compressor 1 and the conduit between the indoor coil 5*a* and the expander 4, condensed refrigerant flows into the defrost conduit 45 and then into the compressor 1.

This is advantageous to the compressor 1 because a certain amount of condensed liquid refrigerant flows into the compression chamber of the compressor 1 and evaporates, thus avoiding overheating.

The defrost conduit 45 should preferably be placed adjacent the outdoor coil 3*a*. Since ice is usually formed at the bottom part of the outdoor coil 3*a* the defrost conduit 45 should also be provided for the bottom half thereof. This arrangement can insure efficient thawing for the indoor coil 5*a*.

Obviously, numerous modifications and variations of the present invention are possible in light of the above teachings. It is therefore to be understood that within the scope of the appended claims, the invention may be practiced otherwise than as specifically described herewith.

What is claimed as new and desired to be secured by Letters Patent of the United States is:

1. A refrigeration system of the type including a compressor, a condenser, an expansion device, an evaporator and interconnection means connected to form a refrigerant flow path therethrough wherein said system further comprises a gaseous refrigerant bypass between a high pressure zone of said system and said compressor through which a portion of the refrigerant from said high pressure gaseous refrigerant zone in said system, said zone including said condenser, is to be injected into said compressor, wherein said gaseous refrigerant bypass has one end connected to the compression chamber of said compressor and the second end in communication with the high pressure gaseous refrigerant zone including said condenser, and a portion of high pressure gaseous refrigerant from the second end is to be injected into said compression chamber of said compressor through said second end.

2. The refrigeration system of claim 1 in which said high pressure gaseous refrigerant bypass is provided inside the housing shell of said compressor whereby a portion of the refrigerant is discharged and returned within said housing shell of said compressor.

3. The refrigeration system of claim 1 comprising an indoor coil which is connected to said compressor and which functions as said condenser in a heating mode operation, an expansion device connected to said indoor coil for expanding the refrigerant, an outdoor coil which is connected to said expansion device and functions as said evaporator in a heating mode operation, a reversing device which is connected to said compressor for changing the direction of the refrigerant flow and said gaseous refrigerant bypass having one end connected to the compression chamber of said compressor and the other end in communication with the high pressure gaseous refrigerant zone at a portion including said indoor coil thereby forming a high pressure bypass.

4. The refrigeration system of claim 3 wherein said gaseous refrigerant bypass is provided with a control device therein for controlling the amount of refrigerant flow therethrough.

5. The refrigeration system of claim 4 in which said control device comprises a capillary tube.

6. The refrigeration system of claim 3 which further comprises a second gaseous refrigerant bypass having one end in communication with said compression chamber of said compressor and the other end in communication with said high pressure gaseous refrigerant zone at a portion including said outdoor coil.

7. The refrigeration system of claim 6 in which said second gaseous refrigerant bypass has a control device for controlling the refrigerant flow therethrough.

8. The refrigeration system of claim 7 which said control device comprises an electric valve for closing and opening said second gaseous refrigerant bypass.

9. The refrigeration system of claim 8 which further comprises a third refrigerant bypass which has one end connected to said compressor and the other end to a midway portion of said expansion device whereby said third gaseous refrigerant introduces a portion of saturated refrigerant into said compressor.

10. The refrigeration system of claim 9 in which said third refrigeration bypass comprises a control device for controlling the flow of refrigerant therethrough.

11. The refrigeration system of claim 4 in which said expansion device is divided into two parts, further comprising a gas liquid separator connected between said two parts of said expansion device and a fourth refrigerant bypass having one end connected to said gas liquid separator and the other end to said compressor whereby a portion of refrigerant in said gas liquid separator is to be introduced into said compressor through said fourth refrigerant bypass.

12. The refrigeration system of claim 11 in which said fourth refrigerant bypass comprises a control device for controlling the refrigerant flow therethrough.

13. The refrigeration system of claim 3 further comprising a fifth refrigerant bypass which has one end connected between said indoor coil and said expansion device and the other end connected to said compressor whereby a mixture of refrigerant from said high pressure gaseous refrigerant bypass and from said fifth refrigerant bypass is to be injected into said compressor.

14. The refrigeration system of claim 13 in which said fifth refrigerant bypass comprises a control device for controlling the refrigerant flow therethrough.

15. The refrigeration system of claim 14 in which said control device for said fifth refrigerant bypass comprises a capillary tube.

16. The refrigeration system of claim 13 which further comprises a plurality of capillary tubes as the control device for said fifth refrigerant bypass and a sixth refrigerant bypass which permits the refrigerant to bypass at least one of said plurality of capillary tubes of said fifth refrigerant bypass.

17. The refrigeration system of claim 16 in which said sixth refrigerant bypass has a control device for controlling the refrigerant flow therethrough.

18. The refrigeration system of claim 3 which further comprises a seventh refrigerant bypass which has one end connected between said indoor coil and said expansion device and other end to said compressor, and a check valve in said seventh bypass, which is directed to said compressor, and an eighth refrigerant bypass which has one end connected between said outdoor coil and said expansion device and other end to said compressor, and a check valve in said eighth bypass, which is directed to said compressor.

* * * * *